US009123305B2

(12) United States Patent
Momose

(10) Patent No.: US 9,123,305 B2
(45) Date of Patent: Sep. 1, 2015

(54) ELECTRO-OPTICAL APPARATUS AND ELECTRONICS DEVICE

(75) Inventor: Yoichi Momose, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 13/240,832

(22) Filed: Sep. 22, 2011

(65) Prior Publication Data

US 2012/0113076 A1 May 10, 2012

(30) Foreign Application Priority Data

Nov. 9, 2010 (JP) ..... 2010-250544

(51) Int. Cl.
*G09G 5/14* (2006.01)
*G09G 3/36* (2006.01)
*G09G 3/00* (2006.01)

(52) U.S. Cl.
CPC ..... *G09G 3/3614* (2013.01); *G09G 3/003* (2013.01); *G09G 3/3648* (2013.01); *G09G 2300/0426* (2013.01); *G09G 2320/028* (2013.01); *G09G 2320/0233* (2013.01); *G09G 2320/0247* (2013.01)

(58) Field of Classification Search
CPC ..... G09G 5/14
See application file for complete search history.

(56) References Cited

U.S. PATENT DOCUMENTS

| | | | | |
|---|---|---|---|---|
| 7,423,625 | B2 | 9/2008 | Lee et al. | |
| 2005/0219196 | A1* | 10/2005 | Lee | 345/100 |
| 2006/0012593 | A1* | 1/2006 | Iriguchi et al. | 345/204 |
| 2007/0273715 | A1 | 11/2007 | Sugiyama | |
| 2008/0150871 | A1* | 6/2008 | Park | 345/98 |
| 2008/0252578 | A1* | 10/2008 | Kim et al. | 345/87 |
| 2009/0079680 | A1* | 3/2009 | Yagiura | 345/87 |
| 2009/0096943 | A1 | 4/2009 | Uehara et al. | |
| 2009/0167846 | A1 | 7/2009 | Niioka et al. | |
| 2010/0164925 | A1* | 7/2010 | Weng | 345/211 |
| 2010/0265284 | A1* | 10/2010 | Satou et al. | 345/697 |
| 2011/0234556 | A1 | 9/2011 | Uehara et al. | |
| 2011/0234582 | A1* | 9/2011 | Daiku et al. | 345/419 |
| 2013/0229394 | A1 | 9/2013 | Uehara et al. | |
| 2014/0036185 | A1 | 2/2014 | Uehara et al. | |

FOREIGN PATENT DOCUMENTS

| | | | |
|---|---|---|---|
| JP | 8-331605 | A | 12/1996 |
| JP | 11-271789 | A | 10/1999 |
| JP | 2004-271617 | A | 9/2004 |
| JP | 2005-234533 | A | 9/2005 |
| JP | 2006-071891 | A | 3/2006 |
| JP | 2007-094027 | A | 4/2007 |
| JP | 2007-316460 | A | 12/2007 |
| JP | 2009-080237 | A | 4/2009 |
| JP | 2009-098311 | A | 5/2009 |
| JP | 2009-157116 | A | 7/2009 |

* cited by examiner

*Primary Examiner* — Joseph Feild
*Assistant Examiner* — Karin Kiyabu
(74) *Attorney, Agent, or Firm* — ALG Intellectual Property, LLC

(57) ABSTRACT

Pairs of a TFT and a pixel electrode, the number of which is (m×n), are provided. The TFT has a gate electrode connected to a scanning line, a source electrode connected to a data line, and a drain electrode connected to the pixel electrode. The pixel electrodes are arrayed in a matrix of m rows and n columns. Each of the pixel electrodes on any column is alternately electrically connected to either of two adjacent data lines via the TFT.

8 Claims, 15 Drawing Sheets

FIG. 10

| PIXEL CONFIGURATION | DRIVING | FLICKER | HORIZONTAL STRIP | VERTICAL CROSS TALK | HORIZONTAL CROSS TALK |
|---|---|---|---|---|---|
| ALLOCATION ACCORDING TO THIS EMBODIMENT | 1-DOT INVERSION | OK | OK | OK | OK |
| | 1-DOT 2-LINE INVERSION | OK | NG | OK | OK |
| | SOURCE LINE INVERSION | NG | OK | OK | OK |
| | GATE LINE INVERSION | OK | OK | OK | NG |
| ALLOCATION ACCORDING TO EXISTING METHOD | 1-DOT INVERSION | NG | OK | OK | OK |
| | 1-DOT 2-LINE INVERSION | OK | NG | OK | OK |
| | SOURCE LINE INVERSION | OK | OK | NG | OK |
| | GATE LINE INVERSION | OK | OK | OK | NG |

FIG. 20

| PIXEL CONFIGURATION | DRIVING | FLICKER | OBLIQUE STRIPE | VERTICAL CROSS TALK | HORIZONTAL CROSS TALK |
|---|---|---|---|---|---|
| ALLOCATION ACCORDING TO THIS EMBODIMENT | 1-DOT INVERSION | OK | OK | OK | OK |
| | 1-DOT 2-LINE INVERSION | OK | NG | OK | OK |
| | SOURCE LINE INVERSION | OK | OK | NG | OK |
| | GATE LINE INVERSION | OK | OK | OK | NG |
| ALLOCATION ACCORDING TO EXISTING METHOD | 1-DOT INVERSION | OK | NG | OK | OK |
| | 1-DOT 2-LINE INVERSION | OK | NG | OK | OK |
| | SOURCE LINE INVERSION | OK | OK | NG | OK |
| | GATE LINE INVERSION | OK | OK | OK | NG |

ELECTRO-OPTICAL APPARATUS AND ELECTRONICS DEVICE

Japanese Patent Application No. 2010-250544, filed Nov. 9, 2010 is incorporated by reference in its entirety herein.

BACKGROUND

1. Technical Field

The present invention relates to an electro-optical apparatus which enables a plurality of different images to be viewed.

2. Related Art

Nowadays, two-view display apparatuses each enabling viewers located at respective different observation positions to view corresponding different images, and three-dimensional display apparatuses each displaying three-dimensional images by enabling a viewer to view images for the right eye thereof and images for the left eye thereof, have been widely well known. There have been image display apparatuses each employing a parallax barrier as one of technologies for enabling a plurality of images to be viewed. In JP-A-8-331605, a display panel, in which each of pixels for the right eye and each of pixels for the left eye are alternately allocated on each of rows, and also, on each of columns, and an optical filter, which is located at the viewer side of the display panel, and separates images for the right eye and images for the left eye, have been disclosed. In JP-A-2005-234533 and JP-A-2006-71891, in a display apparatus not performing a three-dimensional display, for pixel electrodes arrayed along a certain column (along a direction in which data lines extend), pixel electrodes located at even-numbered rows and pixel electrodes located at odd-numbered rows are connected to two different data lines, which are located at the left-hand side and the right-hand side of the certain column, respectively. In each of these display apparatuses, a so-called line inversion driving method is employed. Further, in JP-A-2007-316460 and JP-A-2009-80237, technologies for correction of a cross talk in a three-dimensional image display apparatus or a two-view display apparatus, have been disclosed.

However, technologies disclosed in the above-described patent documents: JP-A-8-331605, JP-A-2005-234533, JP-A-2006-71891, JP-A-2007-316460 and JP-A-2009-80237 still have disadvantages in that degradations of image quality occur due to flickers, horizontal stripes (or oblique stripes), vertical cross talks or horizontal cross talks.

SUMMARY

An advantage of some aspects of the invention is to provide technologies for suppression of occurrence of flickers, horizontal stripes (or oblique stripes), vertical cross talks and horizontal cross talks in a multi-view display apparatus or a three-dimensional image display apparatus.

An electro-optical apparatus according to an aspect of the invention includes a substrate and a parallax barrier which includes apertures each enabling any unit pixel to be viewed in each of at least two directions, the substrate including a plurality of scanning lines; a plurality of data lines; a plurality of pixel electrodes which are provided at intersection points of the plurality of scanning lines and the plurality of data lines, and which are arrayed in a matrix shape; and a plurality of transistors provided so as to correspond to the respective plurality of pixel electrodes. Further, each of the transistors, which corresponds to the unit pixel and is arrayed between a first data line of the plurality of data lines and a second data line of the plurality of data lines, the second data line being located adjacent the first data line, is alternately and electrically connected to either the first data line or the second data line in a direction in which the data lines extend. Furthermore, a polarity of a voltage supplied to the fist data line during a first selection period is inverse to a polarity of a voltage supplied to the fist data line during a second selection period subsequent to the first selection period; a polarity of a voltage supplied to the second data line during the first selection period is inverse to a polarity of a voltage supplied to the second data line during the second selection period; and a polarity of a voltage supplied to the first data line during the first selection period is inverse to a polarity of a voltage supplied to the second data line during the first selection period.

According to this electro-optical apparatus, it is possible to suppress occurrence of flickers, horizontal stripes (or oblique stripes), vertical cross talks and horizontal cross talks to a greater extent, compared with existing configurations in which each of the transistors is not alternately connected to either of the two adjacent data lines.

In the above-described aspect, preferably, the parallax barrier enables k image views to be viewed, k being a natural number more than or equal to "2", and further, in each of the k image views, any unit group of pixels, which forms a matrix of k rows and k columns, may be configured to include one pixel in each of the k rows and one pixel in each of the k columns.

According to this electro-optical apparatus, it is possible to, when allowing k image views to be viewed, suppress occurrence of flickers, horizontal stripes (or oblique stripes), vertical cross talks and horizontal cross talks.

Further, in the above-described aspect, preferably, the unit pixel is configured to include m pixel electrodes of the plurality of pixel electrodes, m being a natural number more than or equal to "1".

According to this electro-optical apparatus, it is possible to, in each of image views displayed by employing pixels each including a plurality of pixel electrodes, suppress occurrence of flickers, horizontal stripes (or oblique stripes), vertical cross talks and horizontal cross talks.

Further, an electronics device according to another aspect of the invention includes any one of the above-described electro-optical apparatuses.

According to this electronics device, it is possible to suppress occurrence of flickers, horizontal stripes (or oblique stripes), vertical cross talks and horizontal cross talks to a greater extent, compared with existing configurations in which each of the transistors is not alternately connected to either of the two adjacent data lines.

BRIEF DESCRIPTION OF THE DRAWINGS

The invention will be described with reference to the accompanying drawings, wherein like numbers reference like elements.

FIG. 10 is a diagram illustrating a result of comparison between image quality resulting from employing an electro-optical apparatus according to this embodiment and image quality resulting from employing existing technologies.

FIG. 20 is a diagram illustrating a result of comparison between image quality resulting from employing an electro-optical apparatus in a modification example 1 and image quality resulting from employing existing technologies.

DESCRIPTION OF EXEMPLARY EMBODIMENTS

1. Configuration

Figure 1:
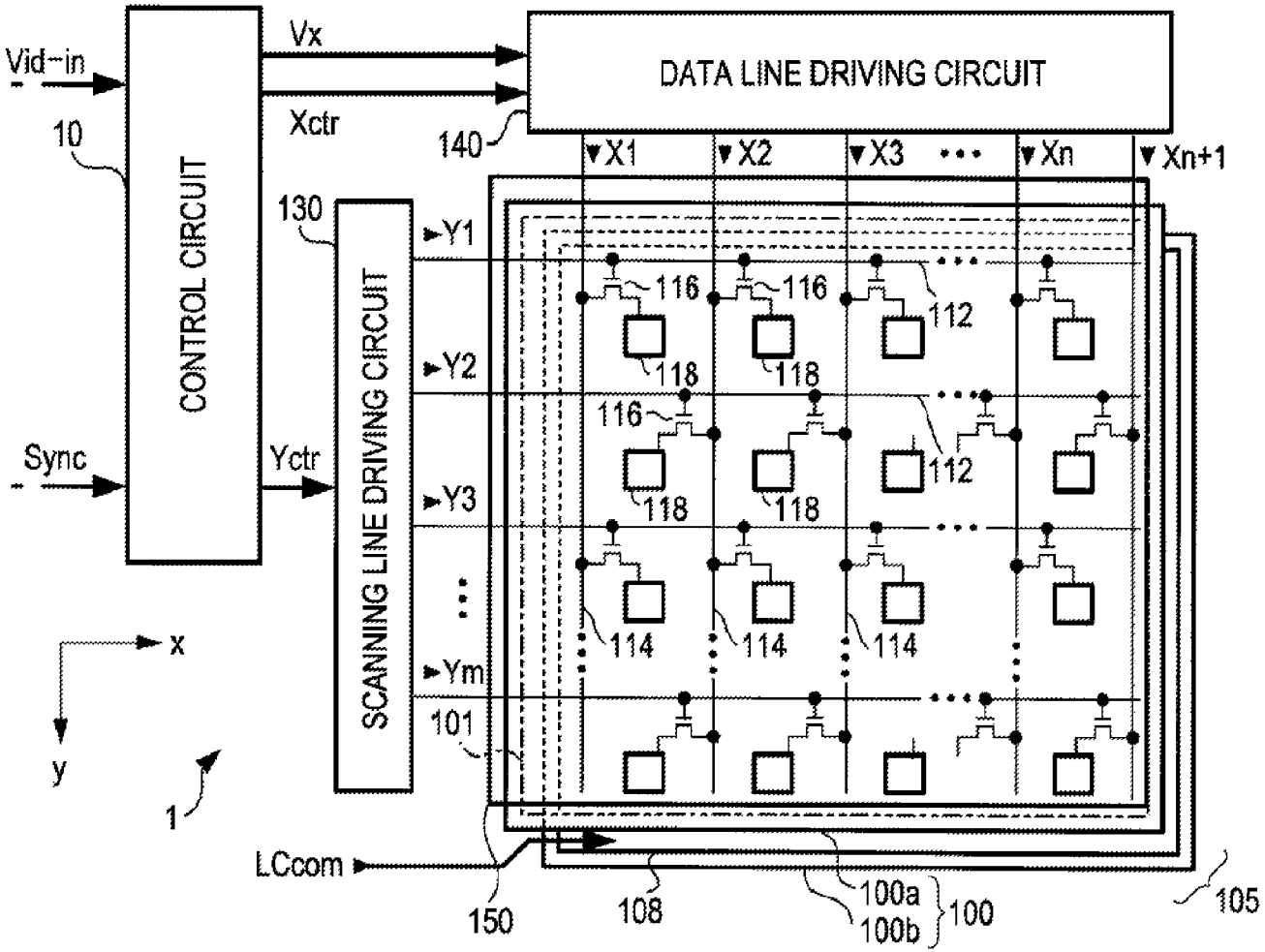
FIG. 1 is a block diagram illustrating a whole configuration of an electro-optical apparatus according to an embodiment of the invention.

FIG. 1 is a block diagram illustrating a whole configuration of an electro-optical apparatus 1 according to an embodiment of the invention. In this embodiment, the electro-optical apparatus 1 is a liquid crystal display apparatus, which employs liquid crystal elements as electro-optical elements and is capable of displaying two image views. The electro-optical apparatus 1 includes a control circuit 10, a liquid crystal panel 100, a scanning line driving circuit 130, a data line driving circuit 140, and a parallax barrier 150.

The control circuit 10 is a circuit for controlling the liquid crystal panel 100. In this embodiment, the control circuit 10 outputs a data signal Vx, a control signal Xctr and a control signal Yctr on the basis of a video signal Vid-in and a synchronization signal Sync. The data signal Vx denotes image (video) data having been converted into binary data represented by two values ("0" and "1"). The control signal Xctr and the control signal Yctr are used for control of the data line driving circuit 140 and the scanning line driving circuit 130, respectively.

The liquid crystal panel 100 is an apparatus for displaying images under control of the control circuit 10. The liquid crystal panel 100 includes an element substrate 100*a*, an opposite substrate 100*b* and a liquid crystal layer 105. The element substrate 100*a* and the opposite substrate 100*b* are bonded to each other so as to keep a constant distance therebetween. On one of surfaces of the element substrate 100*a*, the surface being opposite the opposite substrate 100*b*, m rows of the scanning lines 112 (m is an integer more than or equal to "2"), and (n+1) columns of the data lines 114 (n is an integer more than or equal to "2") are provided. The scanning lines 112 and the data lines 114 are electrically isolated from one another. In addition, when necessary to identify each of the scanning lines 112, from the upper side in FIG. 1, the scanning lines 112 are sequentially called a 1st row of, a 2nd row of, a 3rd row of, . . . an (m−1)th row of, and an m-th row of the scanning lines 112. Similarly, when necessary to identify each of the data lines 114, from the leftmost side in FIG. 1, the data lines 114 are sequentially called a 1st column of, a 2nd column of, a 3rd column of, . . . an (n−1)th column of, an n-th column of, and an (n+1)th column of the data lines.

In this embodiment, the liquid crystal panel 100 is a color display device employing three colors, i.e., red (R), green (G) and blue (B). The liquid crystal panel 100 employs, for example, the wide video graphics array (WVGA) method. That is, the liquid crystal panel 100 has a resolution of 800×480 dots, and pixel electrodes of 2400 (=800×3) columns and 480 rows.

In the element substrate 100*a*, the scanning lines 112 and the data lines 114, which are electrically isolated from one another, are provided so as to extend along an x-axis direction and a y-axis direction shown in FIG. 1, respectively. When viewing from a direction perpendicular to the x-axis direction and the y-axis direction, the scanning lines 112 and the data lines 114 intersect with one another. A pair of a thin film transistor (TFT) 116 and a pixel electrode 118 is provided at a position corresponding to an intersection point of any one of the scanning lines 112 and any one of the data lines 114. That is, as a whole, (m×n) pairs of the TFT 116 and the pixel electrode 118 are provided. The pixel electrode 118 has a substantially rectangular shape, and is formed of a transparent material. In this embodiment, the TFT 116 is an n-channel field-effect transistor. The TFT 116 has a gate electrode connected to any one of the scanning lines 112, a source electrode connected to any one of the data lines 114, and a drain electrode connected to any one of the pixel electrodes 118. The pixel electrode 118 is arrayed in a matrix of m rows and n columns. Along a certain column, each of the pixel electrodes 118 arrayed along the column is alternately connected to either of the two adjacent data lines (via the corresponding TFT transistor 116).

A common electrode 108 is provided across the whole surface of a side of the opposite substrate 100*b*, the side being opposite the element substrate 100*a*. The common electrode 108 is transparent. A voltage LCcom is supplied to the common electrode 108 from a circuit (omitted from illustration).

The scanning line driving circuit 130 is a circuit for supplying scan signals Y1, Y2, Y3, . . . , Ym to the corresponding scanning lines 112. The scanning lines Y1, Y2, Y3, . . . , Ym are each supplied with a pulse-shaped H (High) level signal on a line-by-line basis. For example, when a first row of the scanning lines 112 is supplied with a H level scanning signal, the TFT 116 connected to the first row of the scanning lines 112 is in a turned-on condition. A period of time while any one of the scanning lines 112 is supplied with a H level scanning signal is called a "selection period". Further, an operation, "an i-th row of the scanning lines 112 is supplied with a H level signal" results in an operation, "an i-th row of the pixel electrode 118 is selected".

The data line driving circuit 140 is a circuit for supplying data signals X1, X2, X3, . . . , Xn, Xn+1 to the corresponding data lines 114. The data signals X1, X2, X3, . . . , Xn, Xn+1 each have a voltage in accordance with a block of image data to be written into the corresponding pixel electrode 118. From the data signals supplied to the respective data lines 114, voltages in accordance with blocks of image data are written into the respective pixel electrodes 118 corresponding to a certain selected row. Alignment conditions of liquid crystal molecules included in the liquid crystal layer 105 (i.e., a transmittance ratio of the liquid crystal layer 105) vary in accordance with electric fields occurring between the pixel electrodes 118 and the common electrode 108. This variation of the alignments of the liquid crystal molecules enables realization of gray-scale displaying by means of light modulation.

In addition, in FIG. 1, one of sides of the element substrate 100*a*, the side being opposite the opposite substrate 100*b*, is located at the backside of the paper, and thus, the scanning lines 112, the data lines 114, the TFTs 116 and the pixel electrodes 118 should be drawn in dotted lines; however, taking into account difficulty in recognition, these are drawn in full lines.

Figure 2:
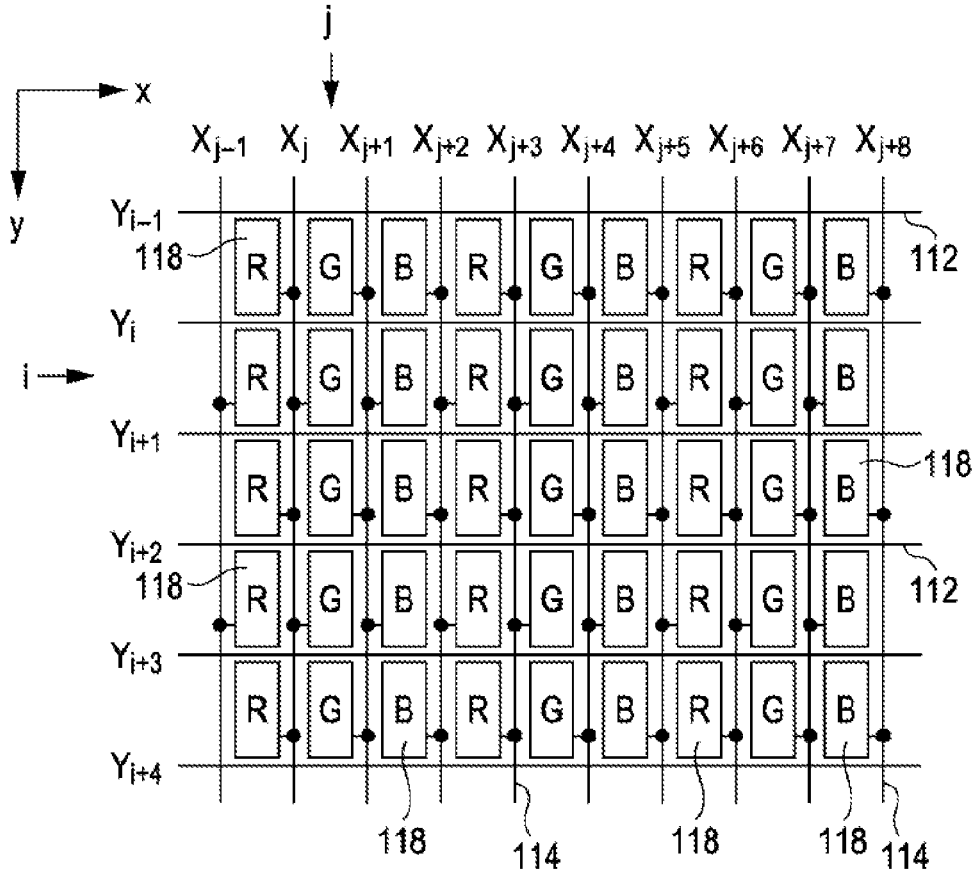
FIG. 2 is a diagram illustrating an example of an allocation of pixels included in a liquid crystal panel according to an embodiment of the invention.

FIG. 2 is a diagram illustrating an example of an allocation of the pixel electrodes 118 included in the liquid crystal panel 100. In FIG. 2, the TFTs 116 are omitted from illustration, and connection relations between the data lines 114 and the pixel electrodes 118 are shown. In FIG. 2, "R", "G" and "B" denote the pixel electrodes 118 for displaying red color, green color and blue color, respectively. Hereinafter, for the sake of simplicity of description, the data line 114 for supplying the data signal Xj and the scanning line 112 for supplying the scanning signal Yi are denoted by a data line Xj and a scanning line Yi, respectively. In addition, i and j are integers that satisfy formulae: $1 \leq i \leq m$ and $1 \leq j \leq n+1$, respectively. Further, the pixel electrodes 118 interposed between the data lines Xj and Xj+1 are denoted by "a j-th column of the pixel electrodes 118", and the pixel electrodes 118 interposed between the scanning lines Yi and Yi+1 are denoted by "an i-th row of the pixel electrodes 118. In the example shown in FIG. 2, the pixel electrodes 118 corresponding to any one of the columns display the same color, and two colors displayed by respective two groups of the pixel electrodes 118, corresponding to two columns located adjacent each other are different from each other. Further, the colors are periodically allocated in an order as follows: R, G and B.

Figure 3:
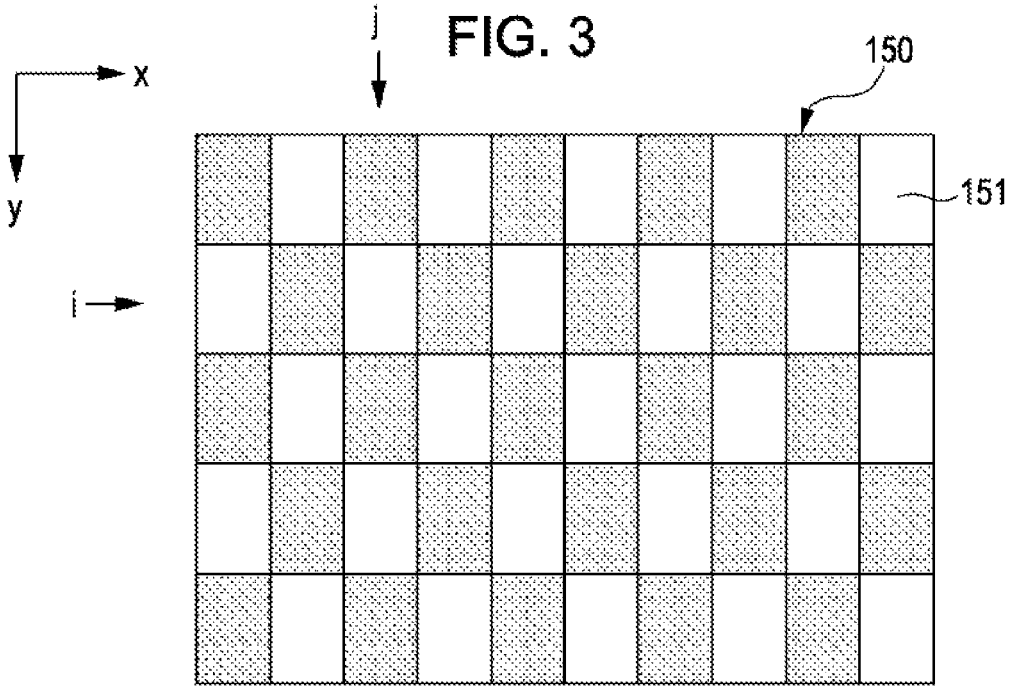
FIG. 3 is a pattern diagram illustrating a configuration of a parallax barrier according to an embodiment of the invention.

FIG. 3 is a pattern diagram illustrating a configuration of a parallax barrier 150 (an example of a parallax barrier). The parallax barrier 150 has a plurality of windows 151 (an example of openings) each transmitting light rays. The window 151 has a width and a height sufficient to allow one pixel to be viewed. In this example, one pixel is configured by one of the pixel electrodes 118. The parallax barrier 150 has the windows 151, the number of which is half the number of the pixels included in the liquid crystal panel 100, i.e., (m×n)/2, because the electro-optical apparatus 1 is a two-view display apparatus and each of first and second image views thereof uses pixels of half the total number of pixels included therein. The windows 151 are arrayed along the x-axis and y-axis directions just like the pixel electrodes 118. Hereinafter, the window located at an intersection point of a j-th column and an i-th row is denoted by the window 151 (j, i). In the example shown in FIG. 3, the windows 151 are arrayed at intervals of one column in the x-axis direction and at intervals of one row in the y-axis direction. That is, if the window 151 (j, i) exists, neither the window 151 (j+1, i) nor the window 151 (j, i+1) exists, but the window 151 (j+1, i+1) exists.

Figure 4:
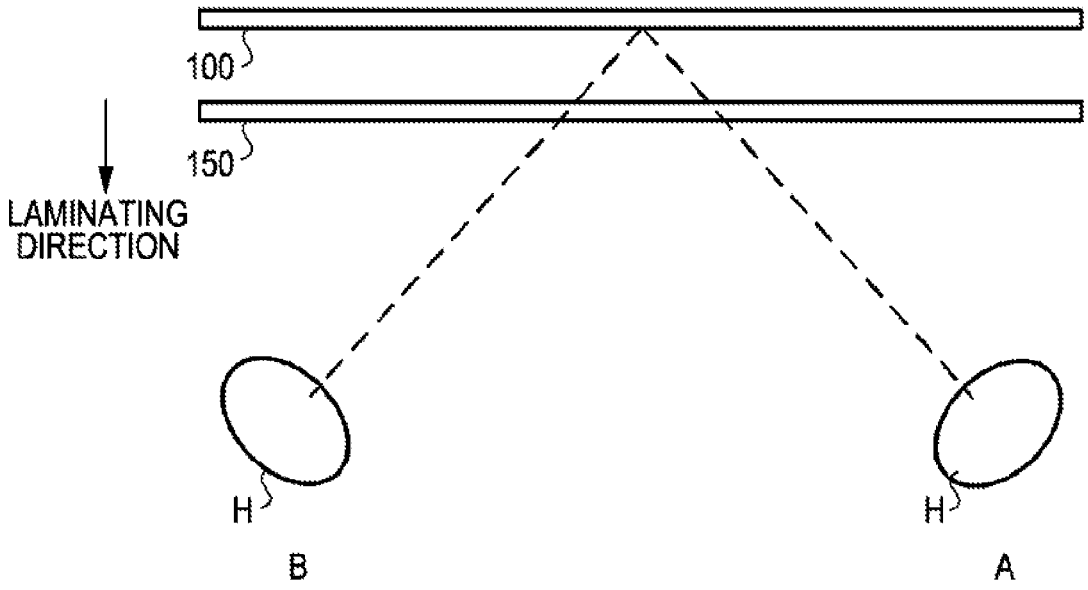
FIG. 4 is a diagram illustrating a relation between a position of a liquid crystal panel and a position of a user, according to an embodiment of the invention.

FIG. 4 is a diagram illustrating a relation between a position of the liquid crystal panel 100 and a position of a user H. A direction in parallel with a direction in which the liquid crystal panel 100 and the parallax barrier 150 are laminated is defined as a front-center direction. From a position A, which is located at a position shifting in a right-hand direction from the front-center direction, the liquid crystal panel 100 is observed in an oblique direction relative to the liquid crystal panel 100. From a position B, which is located at a position shifting in a left-hand direction from the front-center direction, the liquid crystal panel 100 is observed in an oblique direction relative to the liquid crystal panel 100. The electro-optical apparatus 1 is an apparatus configured to enable a user H observing from the position A to view a first image view, and enable a user observing from the position B to view a second image view. A distance between the liquid crystal panel 100 and the parallax barrier 150, and the size and position of each of the windows 151 are designed so as to enable a user H located at the position A to view the first image view, and enable a user H located at the position B to view the second image view.

Figure 5:
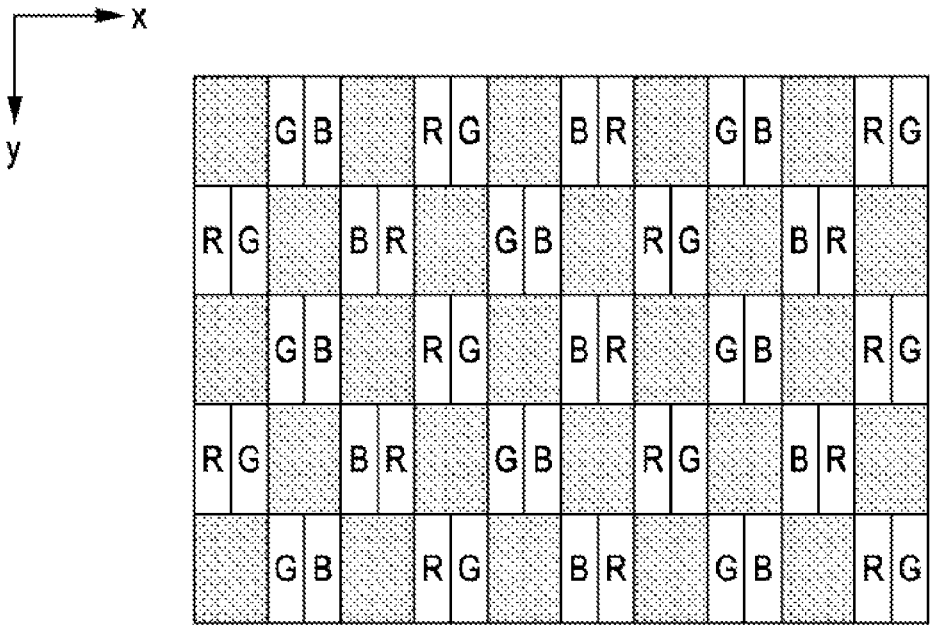
FIG. 5 is a pattern diagram illustrating a condition when viewing a liquid crystal panel from a front side, according to an embodiment of the invention.

FIG. 5 is a pattern diagram illustrating a condition when viewing the liquid crystal panel 100 from the front side. The electro-optical apparatus 1 is not designed so as to enable a user to view a proper image screen from the front-center direction, and thus, it is impossible for a user to view a proper image view from the front-center direction. In this case, from one of the windows 151, images corresponding to the two pixel electrodes 118 are viewed.

2. Operations

Figure 6:
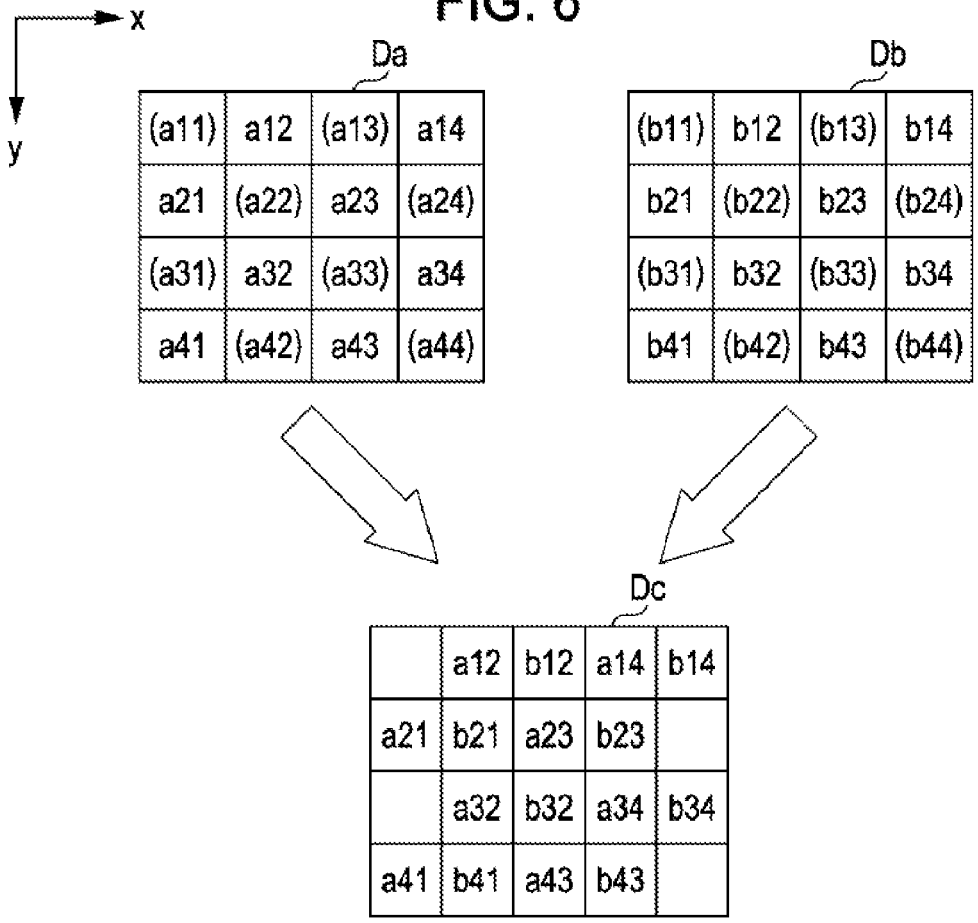
FIG. 6 is a diagram illustrating a configuration of image data included in a video signal, according to an embodiment of the invention.

FIG. 6 is a diagram illustrating a configuration of image data included in the video signal Vid-in. Here, for simplicity of description, an example, in which each of the first image view and the second image view is configured to include pixels of 4 rows and 4 columns, will be described. Data Da and data Db show the first image view and the second image view, respectively. The Data Da includes pieces of pixel data a11 to a44. The data Db includes pieces of pixel data b11 to b44. In the electro-optical apparatus 1, data Dc is source data from which the first image view and the second image view are created. The data Dc is created by combining a part of the data Da and a part of the data Db. In FIG. 6, pixels that are not utilized in the combination for creating the data Dc are each denoted with parentheses. In a first row of the data Dc, a piece of pixel data having a null value is additionally allocated at a leftmost position thereof. Moreover, at respective positions from a position adjacent the leftmost position to a rightmost position in the first row of the data Dc, pieces of pixel data a12, b12, a14 and b14 are allocated. In this case, these pieces of pixel data a12, b12, a14 and b14 are ones having been alternately extracted, in a direction from a left-hand side to a right-hand side, from either pieces of pixel data located at positions corresponding to even numbered columns of the first row of the first image view, or pieces of pixel data located at positions corresponding to even numbered columns of the first row of the second image view. In a second row of the data Dc, at respective positions from the leftmost position, pieces of pixel data a21, b21, a23 and b23 are allocated. In this case, these pieces of pixel data a21, b21, a23 and b23 are ones having been extracted, in a direction from a left-hand side to a right-hand side, from either pieces of pixel data located at positions corresponding to odd numbered columns of the second row of the first image view, or pieces of pixel data located at positions corresponding to odd numbered columns of the second row of the second image view. Further thereto, at the rightmost position of the second row thereof, a piece of pixel data having a null value is additionally allocated. At positions of each of the following rows of the data Dc, pieces of pixel data are allocated in the same manner as or in a manner similar to that described above. As a result, the data Dc is configured to include pixels of 4 rows and 5 columns, which include pixels each having a null value exist. The data Dc is created by a video-content provider. Alternatively, the data Dc may be created by causing an electronics device for supplying the electro-optical apparatus 1 with video signals to combine the data Da and the data Db. In this case, signals representing the data Dc, which result from combination of the data Da and the data Db, are inputted to the control circuit 10 as the video signal Vid-in.

Figure 7:
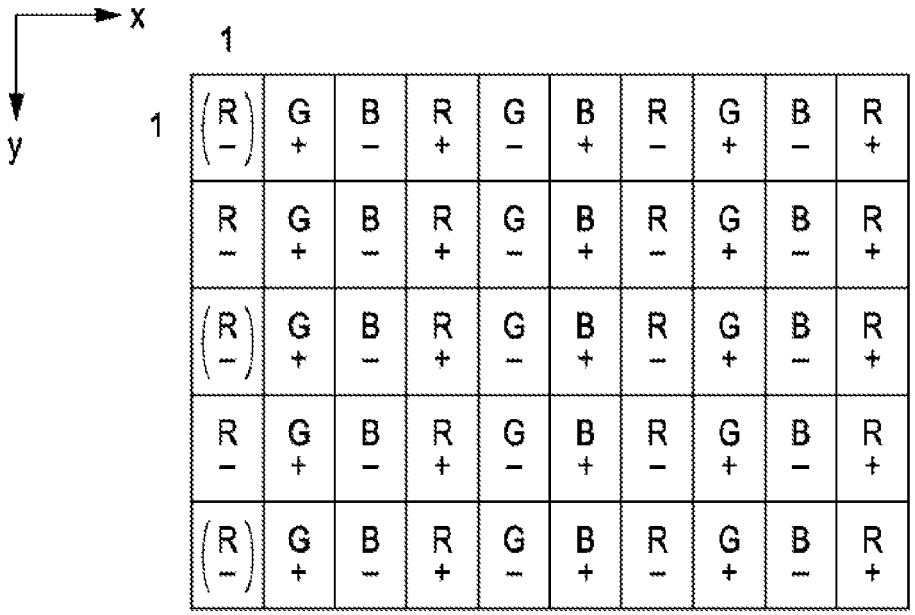
FIG. 7 is a diagram illustrating an example of polarities of data having been written in a certain frame, according to an embodiment of the invention.

FIG. 7 is a diagram illustrating an example of polarities of data having been written in a certain frame. Operations of the scanning line driving circuit 130 and the data line driving circuit 140 are the same as those of existing scanning line driving circuits and data line driving circuits. That is, the scanning line driving circuit 130 outputs signals for sequentially selecting the scanning lines 112 on a line-by-line basis. The data line driving circuit 140 outputs signals having voltages in accordance with pieces of data supplied to a row corresponding to any selected one of the scanning lines 112. In this example, a so-called one-dot inversion method is employed in determining polarities of voltages in accordance with pieces of data to be written. In this one-dot inversion method, polarities of voltages supplied to any adjacent pixels of any one of rows are different from each other, and with respect to polarities of voltages supplied to individual pixels of any two adjacent rows, polarities of voltages in accordance with pieces of data to be written into two pixel electrodes through transistors, which are connected to a certain one of the data lines 114 at two positions located adjacent each other over the certain one of the data lines 114, are different from each other. In other words, a polarity of a voltage supplied to a first data line during a first selection period is inverse to a polarity of a voltage supplied to the first data line during a second selection period subsequent to the first selection period. Further, a polarity of a voltage supplied to a second data line during a first selection period is inverse to a polarity of a voltage supplied to the second data line during a second selection period. Further, a polarity of a voltage supplied to a first data line during a first selection period is inverse to a polarity of a voltage supplied to a second data line during the first selection period. In such a manner as described above, pieces of data are written into the corresponding pixel electrodes 118 connected to any selected one of the scanning lines 112. In the following description, in an image view shown in FIG. 7, a coordinate of the pixel electrode 118 located at the most upper-left position is defined as follows: (x, y)=(1, 1). Similarly, a coordinate of the pixel electrode 118 located at the most upper-rite position is defined as (x, y)=(10, 1), and a coordinate of the pixel electrode 118 located at the most lower-rite position is defined as (x, y)=(10, 5). In addition, in FIG. 7, only the pixel electrodes 118 included within a range: $1 \leq x \leq 10$ and $1 \leq y \leq 5$, are shown, but, actually, the pixel electrodes 118 also exists in areas outside this range. In addition, pieces of data each being denoted with parentheses denote that each of these pieces of data has a null value. That is, pieces of data each having a null value are written into the pixel electrodes 118 located at a first column of odd numbered rows.

Figure 8:
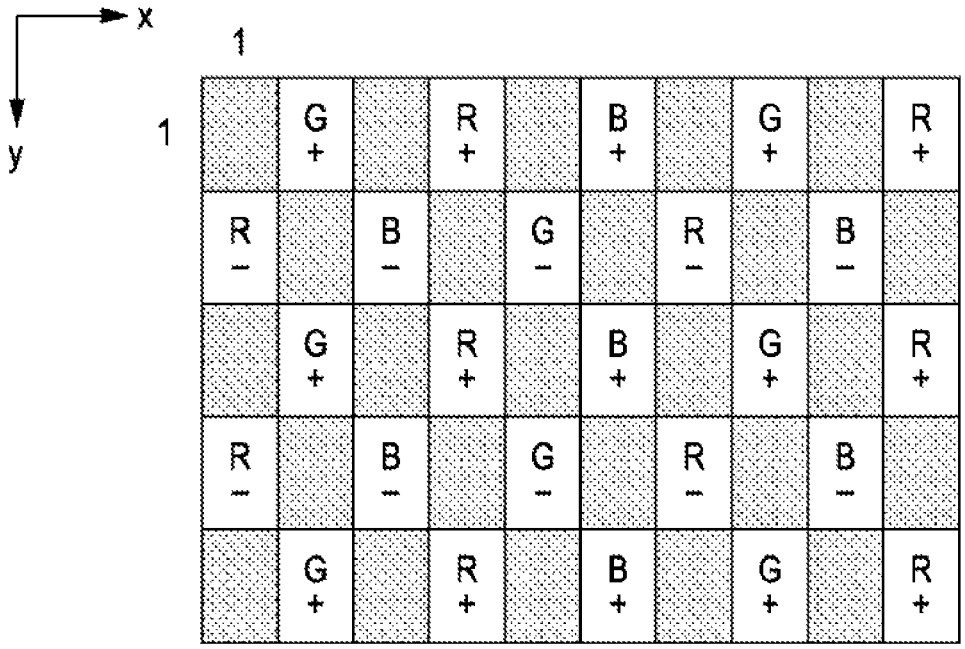
FIG. 8 is a diagram illustrating a first image view according to an embodiment of the invention.

FIG. 8 is a diagram illustrating a first image view that is viewed via the parallax barrier 150 when a block of data shown in FIG. 7 is written into pixel electrodes. In this example, an image, which is created by the pixel electrodes 118 located at positions each having a coordinate (x, y)=(2s+2, 2t+1) and the pixel electrodes 118 located at positions each having a coordinate (x, y)=(2s+1, 2t+2) (s and t are integers each including zero), is viewed. That is, pixel electrodes located at positions each having a coordinate (x, y)=(an odd number, an even number), and pixel electrodes located at positions each having a coordinate (x, y)=(an even number, an odd number) are viewed. Polarities of voltages associated with respective two groups of viewed pixel electrodes, the two groups corresponding to any two adjacent rows, are different from each other.

Figure 9:
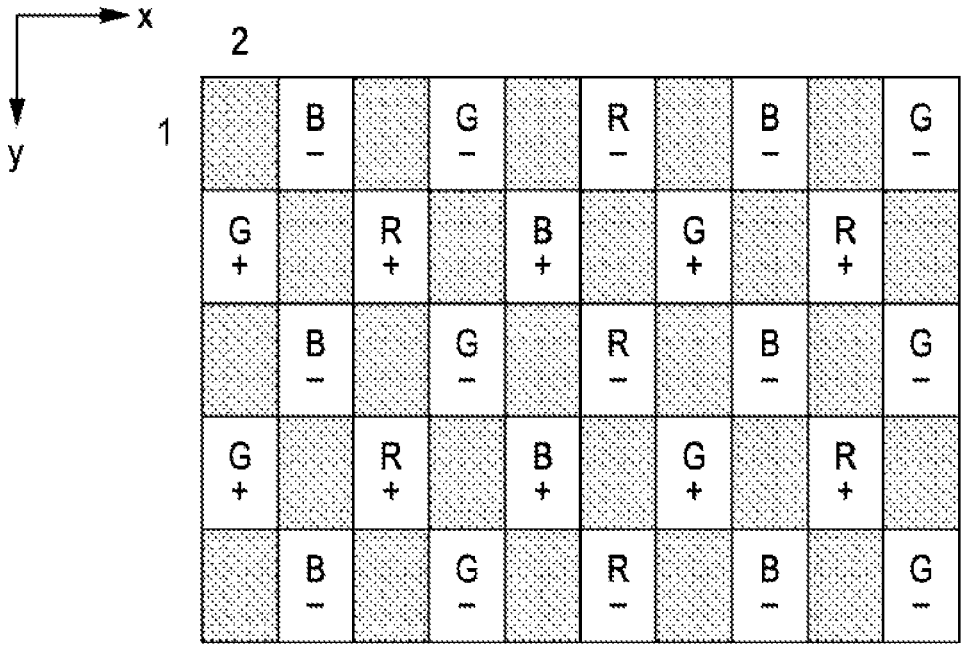
FIG. 9 is a diagram illustrating a second image view according to an embodiment of the invention.

FIG. 9 is a diagram illustrating a second image view that is viewed via the parallax barrier 150 when data shown in FIG. 7 is written into pixel electrodes. In this example, an image, which is created by the pixel electrodes 118 located at positions each having a coordinate (x, y)=(2s+3, 2t+1), and the pixel electrodes 118 located at positions each having a coordinate (x, y)=(2s+2 2t+2) (s and t are integers including zero), is viewed. That is, pixel electrodes each having a coordinate (x, y)=(an odd number, an odd number), and pixel electrodes each having a coordinate (x, y)=(an even number, an even number) are viewed. Polarities of voltages associated with respective two groups of viewed pixel electrodes, the two groups corresponding to any two adjacent rows, are different from each other.

FIG. 10 is a diagram illustrating a result of comparison between image quality resulting from employing the electro-optical apparatus 1 according to this embodiment and image quality resulting from employing existing technologies. In a table shown in FIG. 10, each row denotes image quality resulting from employing a method in which any one of methods for allocating pixel electrodes and any one of driving methods are combined. Each column denotes a phenomenon due to degradations of image quality. A pixel configuration described as "allocation according to this embodiment" means the configuration shown in FIGS. 1 and 2, in which each of the TFTs 116 that are connected to the pixel electrodes 118 arrayed on any one of columns is alternately connected to either of two adjacent data lines. A pixel configuration described as "allocation according to existing method" is a pixel configuration in which each of TFTs that are connected to pixel electrodes on any one of columns is connected to one of data lines. A driving method described as "1 dot inversion" is a method for inverting polarities of data voltages supplied to respective two pixel electrodes that are located adjacent each other in each of any row direction and any column direction (this method is also called "one dot one line inversion"). A driving method described as "one dot two line inversion" is a method for inverting polarities of data voltages supplied to respective two pixel electrodes that are located adjacent each other in the same row direction, and inverting polarities of data voltages supplied to respective pixel electrodes at intervals of two pixels on the same column. In other words, the "one dot two line inversion" method is a method for inverting polarities of data voltages supplied to respective pixel electrodes at intervals of two rows. A driving method described as "source line inversion" is a method for making polarities of data voltages on the same column be the same, and inverting polarities of data voltages supplied to respective pixel electrodes at intervals of one column. A driving method described as "gate line inversion" is a method for making polarities of data voltages supplied to respective pixel electrodes on the same row be the same, and inverting polarities of data voltages supplied to respective pixel electrodes at intervals of one row. In FIG. 10, as phenomena regarding degradation of image quality, "flicker", "horizontal stripe", "vertical cross talk" and "horizontal cross talk" are described. A symbol "NG" shown in FIG. 10 means that the corresponding phenomenon occurs; while a symbol "OK" shown in FIG. 10 means that the corresponding phenomenon does not occur, or a degree of the corresponding phenomenon is lower than in the case of "NG" in any other combinations (that is, the symbol "OK" means that image quality is high from an aspect of the corresponding phenomenon).

Figure 11:
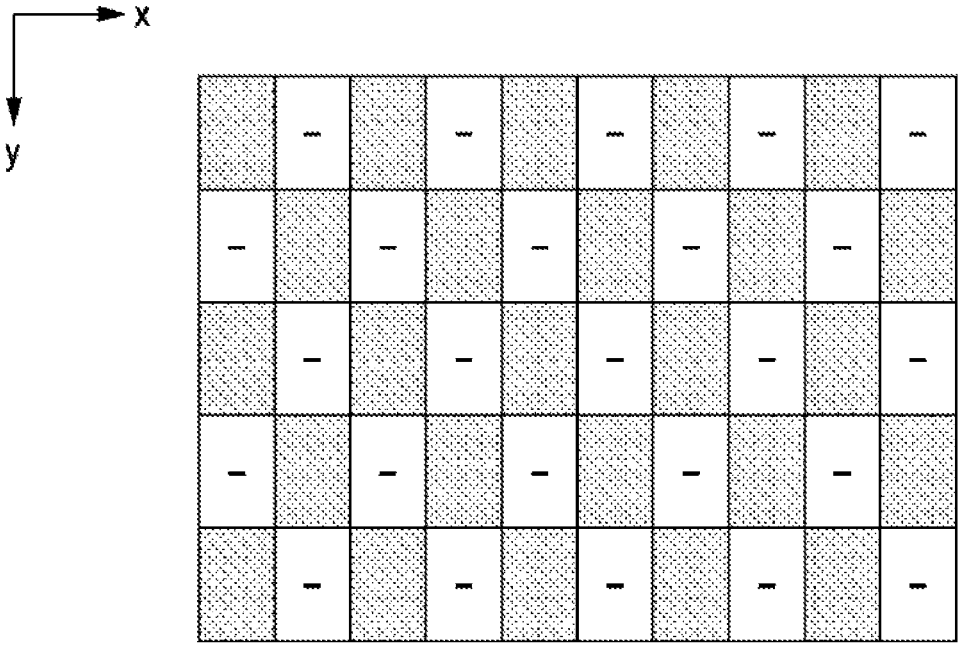
FIG. 11 is a diagram illustrating an image view that is viewed when employing a method in which an existing method for allocation of pixels and a one-dot inversion method are combined.

FIG. 11 is a diagram illustrating an image view that is viewed when employing a method in which the "allocation according to existing method" and the "one dot inversion" is combined. According to the "one dot inversion", polarities of data voltages supplied to respective pixel electrodes that are located adjacent each other in each of any row direction and any column direction are inverse to each other, and thus, when viewing through the parallax barrier 150, polarities of data voltages supplied to all of viewed pixels are the same. That is, according to this combination, in the case where, for example, pixel electrodes corresponding to the first image view are subjected to writing of a block of image data each having a voltage of negative polarity, pixel electrodes corresponding to the second image view are subjected to writing of a block of image data each having a voltage of positive polarity. In the case of the "one dot inversion", polarities of data voltages supplied to respective pixel electrodes are different from each frame. Therefore, in the case of two-view displaying, the first image view, in which pixel electrodes throughout the first image view have respective voltages of negative polarity, and the second image view, in which pixel electrodes throughout the second image view have respective voltages of positive polarity, are alternately displayed, and this operation leads to recognition of occurrence of flickers. This phenomenon arises because, even when two blocks of data D1 and D2 have the same gray-scale value, there is still a difference between brightness of the block of data D1 supplied with a voltage of positive polarity and brightness of the block of data D2 supplied with a voltage of negative polarity. Therefore, as described above, in the combination of one of the pixel configurations, i.e., "allocation according to existing methods" and one of the driving methods, i.e., "one dot inversion", there is a disadvantage in that flickers occurs.

Figure 12:
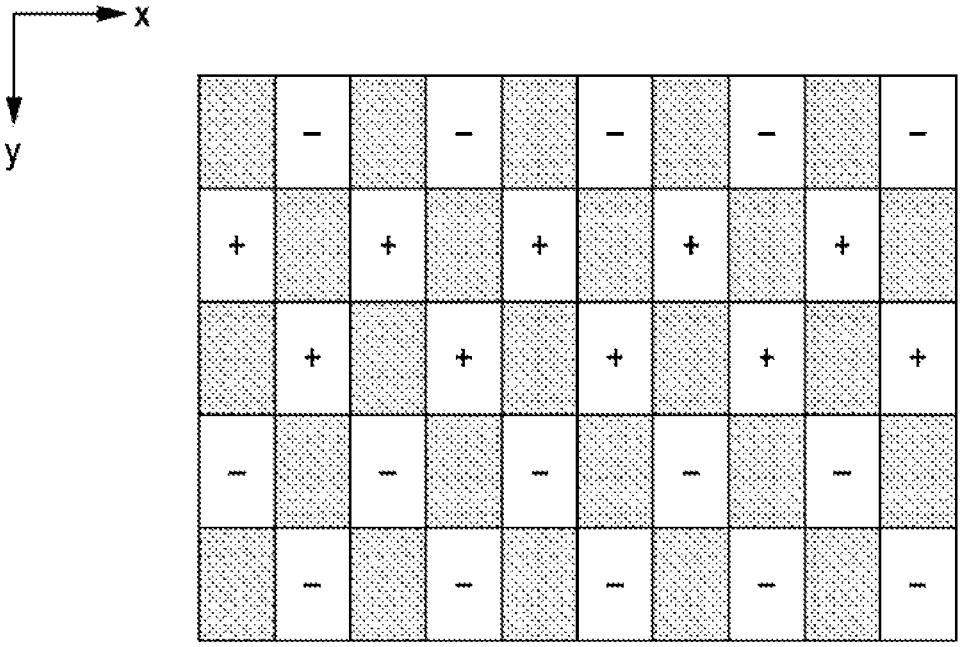
FIG. 12 is a diagram illustrating an image view that is viewed when employing a method in which an existing method for allocation of pixels and a one-dot-two-line inversion method are combined.

FIG. 12 is a diagram illustrating an image view that is viewed when employing a method in which the "allocation according to existing methods" and the "one dot two line inversion" is combined. When viewing through the parallax barrier 150, polarities of data voltages supplied to respective pixel electrodes on any one of rows are the same, and are inverted at intervals of two rows. According to this combination, two rows corresponding to pixel electrodes supplied with respective voltages of the same polarity are likely to be recognized as stripes (horizontal stripes). This phenomenon is likely to occur in methods employing not only the "one dot two line inversion" but also "one dot a plurality of line inversion", such as "one dot three line inversion" and "one dot four line inversion". As described above, in the combination of the "allocation according to existing methods" and the "one dot two line inversion", there is a disadvantage in that horizontal stripes occur.

Figure 13:
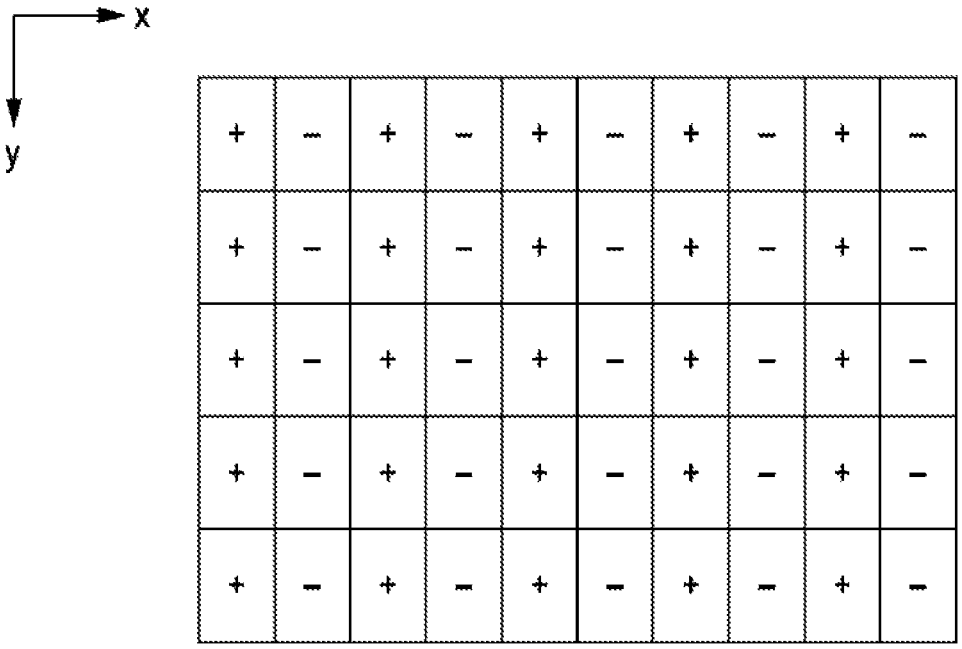
FIG. 13 is a diagram illustrating polarities of data voltages when employing a method in which an existing method for allocation of pixels and a source line inversion method are combined.

FIG. 13 is a diagram illustrating polarities of data voltages when employing a method in which the "allocation according to existing methods" and the "source line inversion" are combined. In this case, all of polarities of data voltages supplied to respective pixel electrodes connected to the same data line (the same source line) are the same, and thus, this operation causes a disadvantage in that a cross talk occurs in a vertical direction.

Figure 14:
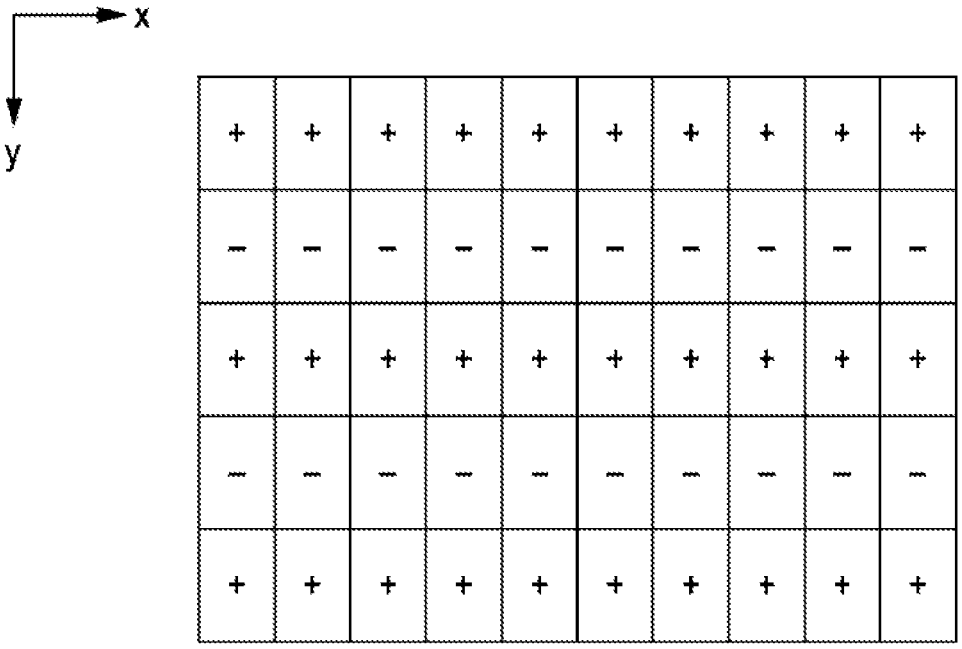
FIG. 14 is a diagram illustrating polarities of data voltages when employing a method in which an existing method for allocation of pixels and a gate line inversion method are combined.

FIG. 14 is a diagram illustrating polarities of data voltages when employing a method in which the "allocation according to existing methods" and the "gate line inversion" are combined. In this case, generally, writing of data into pixel electrodes is performed for each of scanning lines in synchronization with an alternate inversion of a polarity of the common voltage, and thus, this operation causes a disadvantage in that a cross talk occurs in a horizontal direction.

In this regard, according to this embodiment, it is possible to improve the disadvantages, i.e., occurrence of flickers, horizontal stripes, a vertical cross talk or a horizontal cross talk, to a greater degree than in the case where the method "allocation according to existing methods" is employed in configuration of pixels. More specifically, as shown in FIGS. 8 and 9, the first and second image views are not subjected to writing of data voltages of only the same uni-polarity, and thus, the flickers do not occur. Further, polarities of data voltages are alternately inverted for each row, and thus, the horizontal stripes do not occur, either. Furthermore, a polarity of a data voltage supplied to each of pixel electrodes connected to the same data line is alternately inverted for each row, and thus, the vertical cross talk does not occur, either. Furthermore, polarities of data voltages supplied to respective pixel electrodes connected to the same scanning line are alternately inverted for each column, and thus, the horizontal cross talk does not occur, either.

3. Other Embodiments

The invention is not limited to the above-described embodiments, but various modifications can be made. Hereinafter, some modification examples will be described. Two or more of the following modification examples can be combined and utilized.

3-1. Modification Example 1

Figure 15:
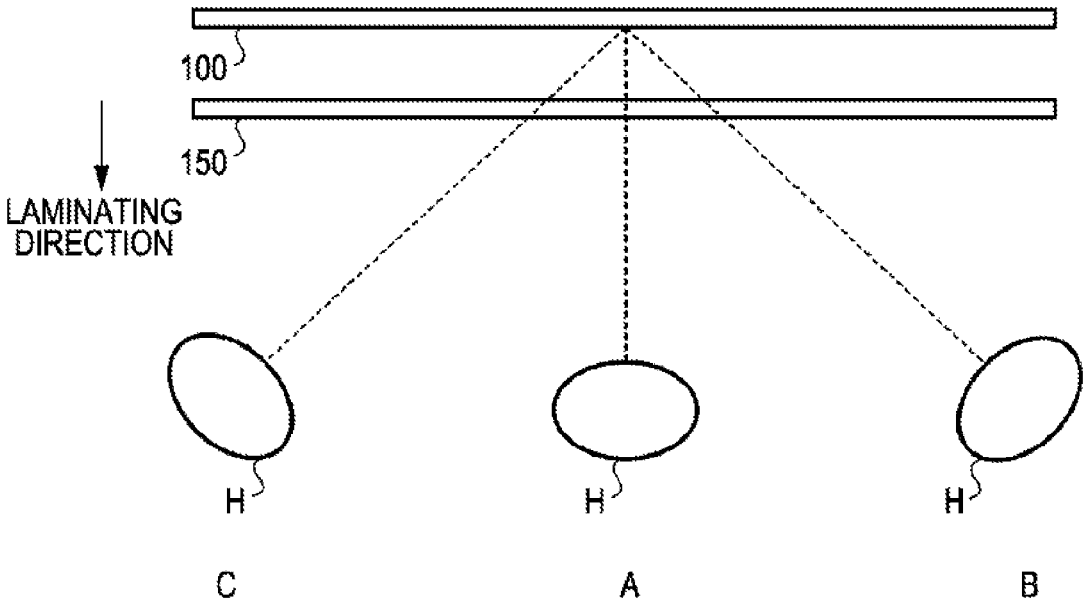
FIG. 15 is a diagram illustrating a relation between a position of a liquid crystal panel and a position of a user, in a modification example 1.

FIG. 15 is a diagram illustrating a relation between a position of the liquid crystal panel 100 and a position of a user H. In the above-described embodiment, an example in which the electro-optical apparatus 1 is a two-view display has been described; while, in this modification example 1, the electro-optical apparatus 1 is a three-view display. From a position A, the liquid crystal panel 100 is observed in a direction parallel with a direction in which the liquid crystal panel 100 and the parallax barrier 150 are laminated, and this direction from the position A to the liquid crystal panel 100 is defined as a front-center direction. From a position B, which is located at a position shifting in a right-hand direction from the front-center direction, the liquid crystal panel 100 is observed in an oblique direction relative to a front panel of the liquid crystal panel 100. From a position C, which is located at a position shifting in a left-hand direction from the front-center direction, the liquid crystal panel 100 is observed in an oblique direction relative to a front panel of the liquid crystal panel 100. The electro-optical apparatus 1 is an apparatus configured to enable a user H observing from the position A to view a first image view; enable a user H observing from the position B to view a second image view; and enable a user H observing from the position C to view a third image view. A distance between the liquid crystal panel 100 and the parallax barrier 150, and the size and position of each of the windows 151 are designed so as to enable a user H observing from the position A to view the first image view; enable a user H observing from the position B to view the second image view; and enable a user H observing from the position C to view the third image view.

Figure 16:
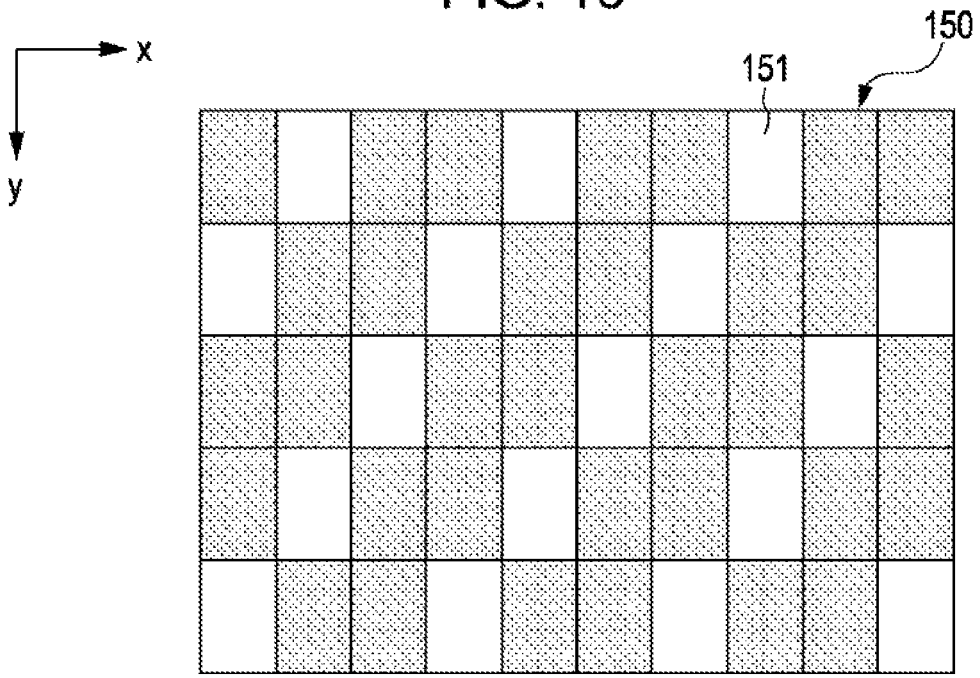
FIG. 16 is a pattern diagram illustrating a configuration of a parallax barrier, in a modification example 1.

FIG. 16 is a pattern diagram illustrating a configuration of the parallax barrier 150 in this modification example 1. In this modification example 1, the parallax barrier 150 has the windows 151, the number of which is one-third the number of the pixels included in the liquid crystal panel 100, i.e., (m×n)/3, because the electro-optical apparatus 1 is a display apparatus having three image views, and each of first, second and third image views employs pixels of one-third the total number of pixels included in the liquid crystal panel 100. In this modification example 1 shown in FIG. 16, the windows 151 are arrayed at intervals of two rows along the x-axis and at intervals of two columns along the y-axis. That is, if the window 151 (j, i) exists, none of the window 151 (j+1, i), the window 151 (j+2, i), the window 151 (j, i+1), the window 151 (j+1, i+1), the window 151 (j, i+2), and the window 151 (j+2, i+2) exists, but the window 151 (j+2, i+1) and the window 151 (j+1, i+2) exist.

Figure 17:
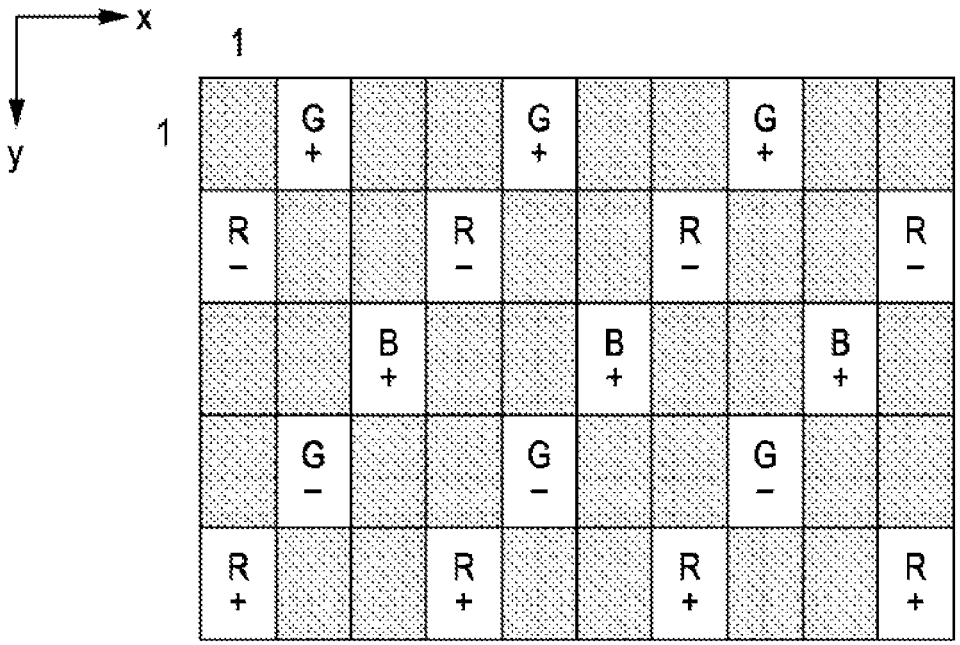
FIG. 17 is a diagram illustrating a first image view that is viewed via a parallax barrier, in a modification example 1.

FIG. 17 is a diagram illustrating a first image view that is viewed via the parallax barrier 150 when a block of data shown in FIG. 7 is written into pixel electrodes. In this example, an image, which is created by the pixel electrodes 118 located at positions each having a coordinate (x, y)=(3s+2, 3t+1), the pixel electrodes 118 located at positions each having a coordinate (x, y)=(3s+1, 3t+2), and the pixel electrodes 118 located at positions each having a coordinate (x, y)=(3s+3, 3t+3) (s and t are integers each including zero), is viewed. In a cluster of pixel electrodes to be viewed, voltage polarities regarding two groups of pixels, corresponding to any two adjacent rows, are different from each other.

Figure 18:
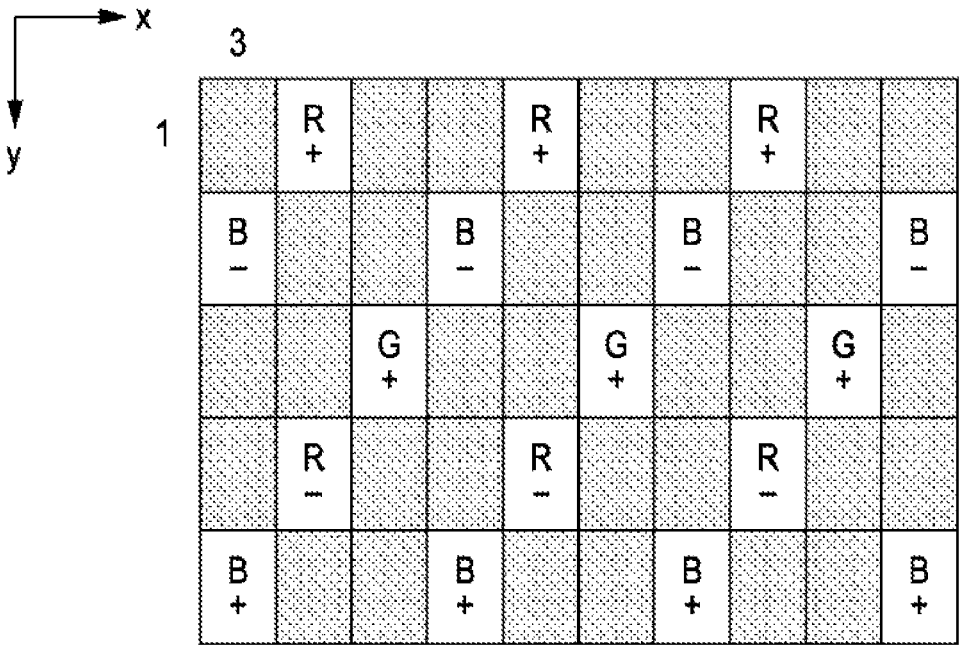
FIG. 18 is a diagram illustrating a second image view that is viewed via a parallax barrier, in a modification example 1.

FIG. 18 is a diagram illustrating a second image view that is viewed via the parallax barrier 150 when a block of data shown in FIG. 7 is written into pixel electrodes. In this example, an image, which is created by the pixel electrodes 118 located at positions each having a coordinate (x, y)=(3s+4, 3t+1), the pixel electrodes 118 located at positions each having a coordinate (x, y)=(3s+3, 3t+2), and the pixel electrodes 118 located at positions each having a coordinate (x, y)=(3S+5, 3t+3) (s and t are integers each including zero), is viewed. In a cluster of pixel electrodes to be viewed, voltage polarities regarding respective two groups of pixels, corresponding to any two adjacent rows, are different from each other.

Figure 19:
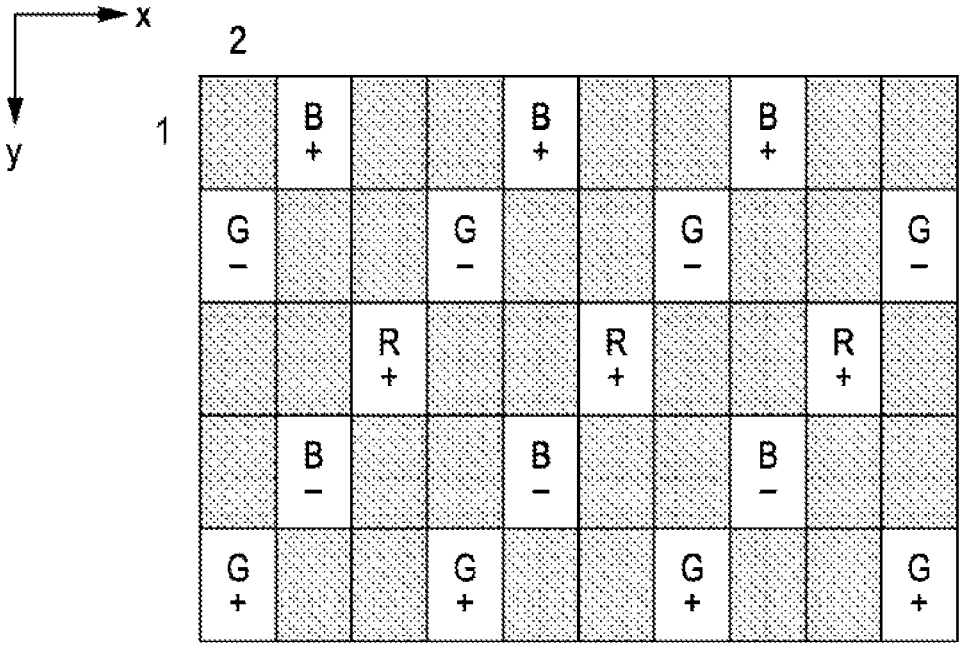
FIG. 19 is a diagram illustrating a third image view that is viewed via a parallax barrier, in a modification example 1.

FIG. 19 is a diagram illustrating a third image view that is viewed via the parallax barrier 150 when a block of data shown in FIG. 7 is written into pixel electrodes. In this example, an image, which is created by the pixel electrodes 118 located at positions each having a coordinate (x, y)=(3s+3, 3t+1), the pixel electrodes 118 located at positions each having a coordinate (x, y)=(3s+2, 3t+2), and the pixel electrodes 118 located at positions each having a coordinate (x, y)=(3S+4, 3t+3) (s and t are integers each including zero), is viewed. In a cluster of pixel electrodes to be viewed, voltage polarities regarding respective two groups of pixels, corresponding to any two adjacent rows, are different from each other.

FIG. 20 is a diagram illustrating a result of comparison between image quality resulting from employing the electro-optical apparatus 1 according to this modification example 1 and image quality resulting from employing existing technologies. In a table shown in FIG. 20, each row denotes image quality resulting from employing a method in which any one of methods for allocating pixel electrodes and any one of driving methods are combined. Each column denotes a phenomenon due to any degradation of image quality. Allocation methods regarding the pixel electrodes 118 (i.e., connection relations regarding the pixel electrodes 118 and the data lines 114) and driving methods are the same as those having been described in the embodiment. In FIG. 20, as phenomena due to any degradation of image quality, "flickers", "oblique stripes", "vertical cross talks" and "horizontal cross talks" are shown.

Figure 21:
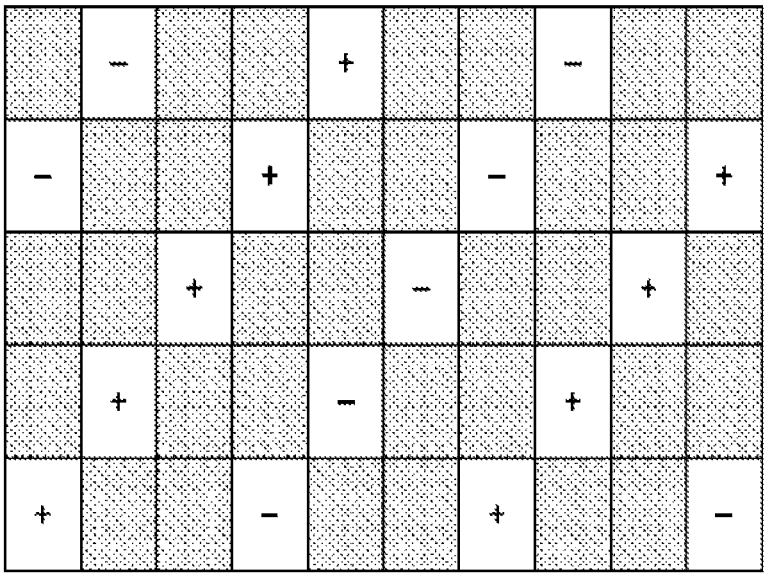
FIG. 21 is a diagram used for description of oblique stripes.

FIG. 21 is a diagram used for description of the oblique stripes. The "oblique stripes" are a phenomenon in which stripes are viewed in oblique directions because pixel electrodes, into which data voltages of the same polarity are written, are arrayed in oblique directions. A combination of the "allocation according to existing methods" and the "one dot inversion" causes the oblique stripes, but, as shown in FIGS. 17 to 19, a combination of the "allocation according to this embodiment" and the "one dot inversion" does not cause the oblique stripes. Further, the combination of the "allocation according to this embodiment" and the "one dot inversion" does not cause the flickers, the vertical cross talks and the horizontal cross talks, either.

As described above, the electro-optical apparatus 1 is not limited to a two-view display, but, may be a three-view display. Moreover, as a result of generalization, the electro-optical apparatus 1 may be a k-view display for enabling k image views to be viewed (k is an integer more than or equal to "2"). In this case, the parallax barrier 150 has the windows 151, the number of which is (m×n)/k. Assuming that a group of the pixel electrodes 118 forming a matrix of k rows and k columns is a unit cell, in the cell unit, only one pixel exists in each of k rows, and only one pixel exists in each of k columns. Moreover, the electro-optical apparatus 1 is not limited to a display enabling the same image view thereof to be viewed from a plurality of view points, but, may be a three-dimensional display capable of displaying three-dimensional images by enabling the right and left eyes of a user to simultaneously view respective different images. Namely, it is necessary for the electro-optical apparatus 1 just to have a parallax barrier including apertures each enabling any unit pixel to be viewed in at least two directions.

3-2. Modification Example 2

Figure 22:
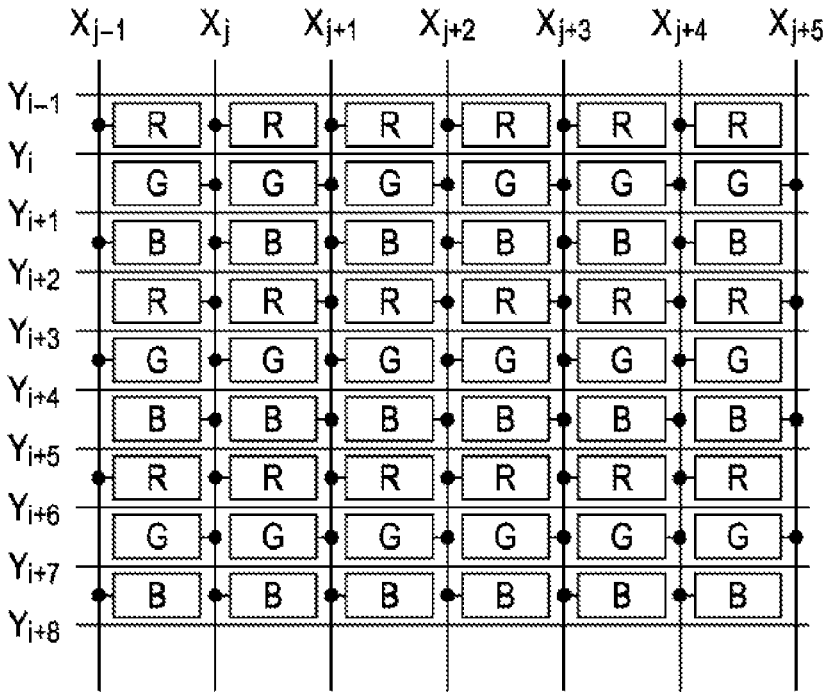
FIG. 22 is a diagram illustrating an allocation of pixel electrodes in a modification example 2.

FIG. 22 is a diagram illustrating an allocation of the pixel electrodes 118 in this modification example 2. In the example shown in FIG. 2, each of the pixel electrodes 118 is vertically long (i.e., in a long shape along the y-axis direction), and pixels each having a different color are arrayed in a short-side direction (i.e., in the x-axis direction). That is, in any one of the rows, pixels of R, G and B are periodically arrayed. In contrast, as shown FIG. 22, each of the pixel electrodes 118 is horizontally long (i.e., in a long shape along the x-axis direction), and pixels each having a different color are arrayed in a short-side direction (i.e., in the y-axis direction). That is, the pixel electrodes 118 each having R, G or B are periodically arrayed in any one of the columns thereof. In this case, the parallax barrier 150 has a configuration obtained by rotating the parallax barrier 150 shown in FIG. 3 by 90 degrees. As described above, the liquid crystal panel 100 may be configured so as to make colors of pixels arrayed along any one of rows be the same, and cause pixels each having a different color to be periodically allocated along any one of columns.

3-3. Modification Example 3

Figure 23:
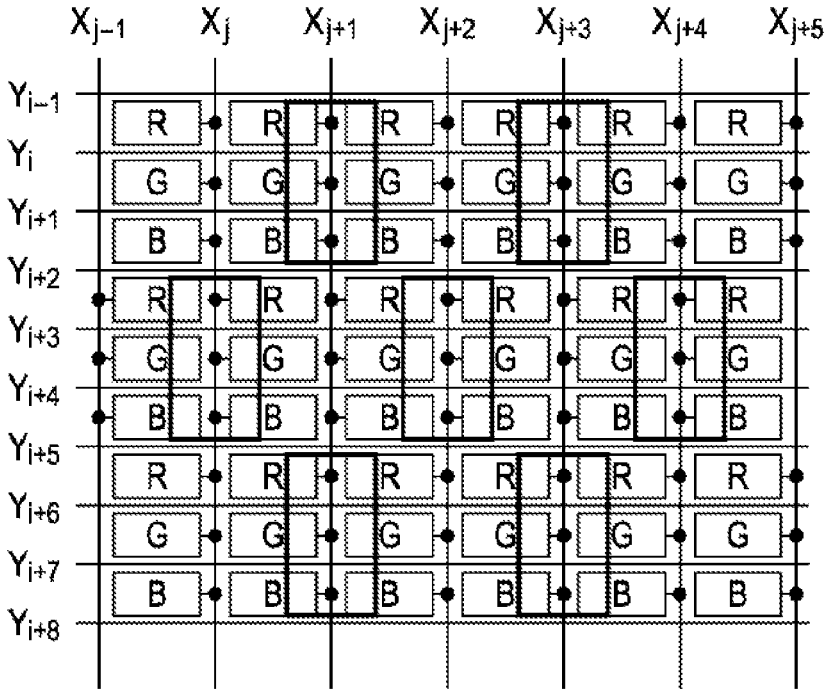
FIG. 23 is a diagram illustrating an allocation of pixel electrodes in a modification example 3.

FIG. 23 is a diagram illustrating an allocation of the pixel electrodes 118 in this modification example 3. In the above-described embodiment, the example, in which the pixel electrodes 118 correspond to respective pixels, has been described, but one pixel may be configured by a plurality of the pixel electrodes 118. In this modification example 3, three pixels each having R, G or B is treated as a set of (i.e., a unit of) pixels. That is, a group of pixel electrodes corresponding to a set of pixels are connected to the same data line. In any one of columns, each of the TFTs 116 is alternately connected to either of two adjacent data lines for each pixel, that is, for each set of pixels. In other words, a second set of pixels, which is located adjacent the first set of pixels in the y-axis direction, is connected to a data line different from that connected to the first set of pixels. In this case, each of the windows 151 included in the parallax barrier 150 has a size corresponding to that of a set of pixels. In FIG. 23, the windows 151 in the case of a two-view display are drawn in thick lines. As described above, the liquid crystal panel 100 may be configured to make n pixels be one set of pixels (n is a natural number more than or equal to "1"; n="3" in this case; and n="1" in the case of the embodiment and the modification examples 1 and 2), and cause a second set of pixels, which is located adjacent a first set of pixels in the data line 114 direction, to be connected to a data line different from that to which the first set of pixels is connected.

3-4. Modification Example 4

Figure 24:
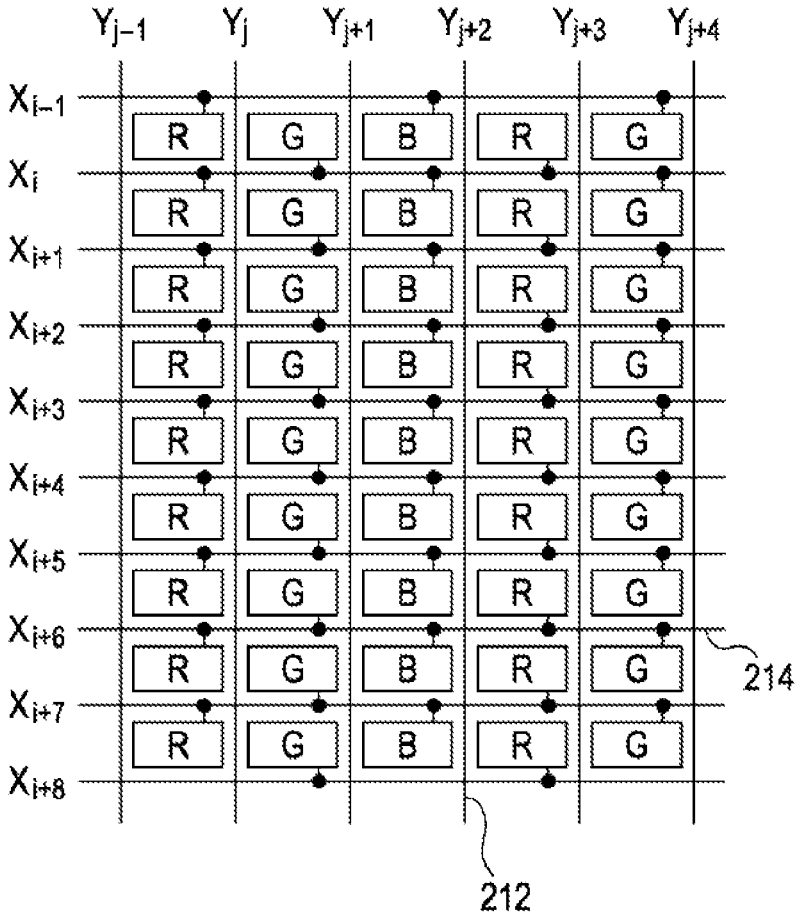
FIG. 24 is a diagram illustrating an allocation of pixel electrodes in a modification example 4.

FIG. 24 is a diagram illustrating an allocation of the pixel electrodes 118 according to this modification example 4. In this example, the scanning lines 212 and the data lines 214 are allocated in parallel with the y-axis direction and the x-axis direction, respectively. In this manner, the liquid crystal panel 100 may be configured to cause the scanning lines 212 and the data lines 214 to be arrayed in parallel with the y-axis direction and the x-axis direction, respectively.

3-5. Modification Example 5

Figure 25:
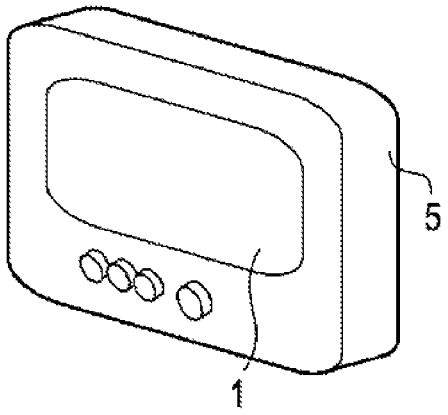
FIG. 25 is a block diagram illustrating a configuration of an electronics device in a modification example 5.

FIG. 25 is a block diagram illustrating a configuration of an electronics device 5 according to this modification example 5. The electronics device 5 includes the electro-optical apparatus 1. In this example, the electronics device 5 is a car navigation device. As other examples, the electronics device 5 may be a 3D television receiver, a digital signage apparatus, a mobile telephone, and a portable game machine.

3-6. Other Modification Examples

A method for creating the data Dc is not limited to that having been described in the embodiment. In the embodiment, the data Dc is created by combining a part of the data Da representing the first image view and a part of the data Db representing the second image view. Meanwhile, the data Dc may be created by combining the entire data Da and the entire data Db. In this case, data Dc consisting of pixels located at intersection points of 4 rows and 5 columns is created from data Da and data Db, each consisting of pixels located at intersection points of 2 rows and 2 columns. In other words, in data, consisting of pixels with no parentheses in the example shown in FIG. 6, and being located at intersection points of 2 rows and 2 columns, two blocks of data, each resulting from inserting one column between two adjacent columns, and rearranging pixels so that pixels each having a non-null value can be arrayed alternately between two adjacent rows, may be combined.

What is claimed is:

1. An electro-optical apparatus comprising:

a parallax barrier which includes apertures each enabling any unit pixel to be viewed in each of at least two directions, a plurality of scanning lines, a plurality of data lines, a plurality of pixel electrodes which are provided at intersection points of the plurality of scanning lines and the plurality of data lines, and which are arrayed in a matrix shape, and a plurality of transistors provided so as to respectively correspond to the plurality of pixel electrodes, wherein each of the plurality of transistors, which corresponds to the unit pixel and is allocated between a first data line of the plurality of data lines and a second data line of the plurality of data lines, the second data line being located adjacent the first data line, is alternately and electrically connected to either the first data line or the second data line in a direction in which the plurality of data lines extend such that a first plurality of pixel electrodes positioned between the first data line and the second data line are each directly electrically connected to the first data line by a corresponding one of the plurality of transistors and are not directly electrically connected to the second data line, and such that a second plurality of pixel electrodes positioned between the first data line and the second data line are each directly electrically connected to the second data line by a corresponding one of the plurality of transistors and are not directly electrically connected to the first data line, a first polarity of a signal supplied to a first pixel electrode through the first data line during a first selection period is inverse to a second polarity of a signal supplied to a second pixel electrode through the first data line during a second selection period subsequent to the first selection period, the first selection period being a period of time during which a first scanning line is supplied with a scanning signal and the second selection period being a period of time immediately subsequent to the first selection period during which a second scanning line adjacent to the first scanning line is supplied with a scanning signal, a third polarity of a signal supplied to a third pixel electrode through the second data line during the first selection period is inverse to a fourth polarity of a signal supplied to a fourth pixel electrode through the second data line during the second selection period, the first polarity of the signal supplied to the first pixel electrode through the first data line during the first selection period is inverse to the third polarity of the signal supplied to the third pixel electrode through the second data line during the first selection period and the second polarity of the signal supplied to the second pixel electrode through the first data line during the second selection period is inverse to the fourth polarity of the signal supplied to the fourth pixel electrode through the second data line during the second selection period, the parallax barrier enables k image views to be viewed, k being a natural number more than or equal to "2,"

in each of the k image views, any unit group of pixels, which forms a matrix of k rows and k columns, is configured to include one pixel in each of the k rows and one pixel in each of the k columns, the first pixel electrode is disposed adjacent to the third pixel electrode along a first direction in which the plurality of scanning lines extend, the second pixel electrode is disposed adjacent to the fourth pixel electrode along the first direction, and the second pixel electrode is disposed adjacent to the third pixel electrode along a second direction in which the plurality of data lines extend.

2. The electro-optical apparatus according to claim 1, wherein the unit pixel is configured to include m pixel electrodes of the plurality of pixel electrodes, m being a natural number more than or equal to "1".

3. An electronics device comprising the electro-optical apparatus according claim 1.

4. The electro-optical apparatus according to claim 1, wherein one aperture is defined in the parallax barrier for each three or more of the plurality of pixel electrodes.

5. The electro-optical apparatus according to claim 1, wherein polarities of a plurality of pixel electrodes which are positioned between the first data line and the second data line are the same.

6. An electro-optical apparatus comprising:

a parallax barrier which includes apertures each enabling any unit pixel to be viewed in each of at least two directions;

a plurality of scanning lines;

a plurality of data lines;

a plurality of pixel electrodes which are provided at intersection points of the plurality of scanning lines and the plurality of data lines, and which are arrayed in a matrix shape, and a plurality of transistors provided so as to respectively correspond to the plurality of pixel electrodes;

a first unit of pixels configured of at least three pixels arrayed along the data lines; and a second unit of pixels configured of at least three pixels arrayed along the data lines, wherein the first unit of pixels is located adjacent the second unit of pixels, wherein the first unit of pixels and the second unit of pixels are allocated between a first data line of the plurality of data lines and a second data line of the plurality of data lines, the second data line being located adjacent the first data line, and all of transistors of the first unit of pixels are directly electrically connected to the first data line, wherein all of transistors of the second unit of pixels are directly electrically connected to the second data line, a first polarity of a signal supplied to a first pixel electrode through the first data line during a first selection period is inverse to a second polarity of a signal supplied to a second pixel electrode through the first data line during a second selection period subsequent to the first selection period, the first selection period being a period of time during which a first scanning line is supplied with a scanning signal and the second selection period being a period of time immediately subsequent to the first selection period during which a second scanning line adjacent to the first scanning line is supplied with a scanning signal, a third polarity of a signal supplied to a third pixel electrode through the second data line during the first selection period is inverse to a fourth polarity of a signal supplied to a fourth pixel electrode through the second data line during the second selection period, the first polarity of the signal supplied to the first pixel electrode through the first data line during the first selection period is inverse to the third polarity of the signal supplied to the third pixel electrode through the second data line during the first selection period and the second polarity of the signal supplied to the second pixel electrode through the first data line during the second selection period is inverse to the fourth polarity of the signal supplied to the fourth pixel electrode through the second data line during the second selection period, the parallax barrier enables k image views to be viewed, k being a natural number more than or equal to "2,"

in each of the k image views, any unit group of pixels, which forms a matrix of k rows and k columns, is configured to include one pixel in each of the k rows and one pixel in each of the k columns, the first pixel electrode is disposed adjacent to the third pixel electrode along a first direction in which the plurality of scanning lines extend, the second pixel electrode is disposed adjacent to the fourth pixel electrode along the first direction, and the second pixel electrode is disposed adjacent to the third pixel electrode along a second direction in which the plurality of data lines extend.

7. An electro-optical apparatus comprising:

a first data line;

a second data line which is located adjacent the first data line;

a first unit of pixels which is allocated between the first data line and the second data line;

a second unit of pixels which is allocated between the first data line and the second data line and located adjacent the first unit of pixels in a direction along the first data line;

a parallax barrier which includes apertures each enabling the first unit of pixels and the second unit of pixels to be viewed in two different directions, wherein all transistors of the first unit of pixels are directly electrically connected to the first data line and all transistors of the second unit of pixels are directly electrically connected to the second data line, a first polarity of a signal supplied to a first pixel electrode through the first data line during a first period is inverse to a second polarity of a signal supplied to a second pixel electrode through the first data line during a second period subsequent to the first period, the first period being a period of time during which a first scanning line is supplied with a scanning signal and the second period being a period of time immediately subsequent to the first period during which a second scanning line adjacent to the first scanning line is supplied with a scanning signal, a third polarity of a signal supplied to a third pixel electrode through the second data line during the first period is inverse to a fourth polarity of a signal supplied to a fourth pixel electrode through the second data line during the second period, the first polarity of the signal supplied to the first pixel electrode through the first data line during the first period is inverse to the third polarity of the signal supplied to the third pixel electrode through the second data line during the first period and the second polarity of the signal supplied to the second pixel electrode through the first data line during the second period is inverse to the fourth polarity of the signal supplied to the fourth pixel electrode through the second data line during the second period, the parallax barrier enables k image views to be viewed, k being a natural number more than or equal to "2,"

in each of the k image views, any unit group of pixels, which forms a matrix of k rows and k columns, is configured to include one pixel in each of the k rows and one pixel in each of the k columns, the first pixel electrode is disposed adjacent to the third pixel electrode along a first direction in which the plurality of scanning lines extend, the second pixel electrode is disposed adjacent to the fourth pixel electrode along the first direction, and the second pixel electrode is disposed adjacent to the third pixel electrode along a second direction in which the plurality of data lines extend.

8. An electro-optical apparatus comprising:

a first data line;

a second data line which is located adjacent the first data line;

a first pixel which is allocated between the first data line and the second data line;

a second pixel which is allocated between the first data line and the second data line, and located adjacent the first pixel in a direction along the first data line;

a parallax barrier which includes apertures each enabling the first pixel and the second pixel to be viewed in two different directions, wherein a transistor of the first pixel is directly electrically connected to the first data line and a transistor of the second pixel is directly electrically connected to the second data line, a first polarity of a signal supplied to a first pixel electrode through the first data line during a first period is inverse to a second polarity of a signal supplied to a second pixel electrode through the first data line during a second period subsequent to the first period, the first period being a period of time during which a first scanning line is supplied with a scanning signal and the second period being a period of time immediately subsequent to the first period during which a second scanning line adjacent to the first scanning line is supplied with a scanning signal, a third polarity of a signal supplied to a third pixel electrode through the second data line during the first period is inverse to a fourth polarity of a signal supplied to a fourth pixel electrode through the second data line during the second period, the first polarity of the signal supplied to the first pixel electrode through the first data line during the first period is inverse to the third polarity of the signal supplied to the third pixel electrode through the second data line during the first period and the second polarity of the signal supplied to the second pixel electrode through the first data line during the second period is inverse to the fourth polarity of the signal supplied to the fourth pixel electrode through the second data line during the second period, the parallax barrier enables k image views to be viewed, k being a natural number more than or equal to "2,"

in each of the k image views, any unit group of pixels, which forms a matrix of k rows and k columns, is configured to include one pixel in each of the k rows and one pixel in each of the k columns, the first pixel electrode is disposed adjacent to the third pixel electrode along a first direction in which the plurality of scanning lines extend, the second pixel electrode is disposed adjacent to the fourth pixel electrode along the first direction, and the second pixel electrode is disposed adjacent to the third pixel electrode along a second direction in which the plurality of data lines extend.

* * * * *